US010016653B2

(12) United States Patent
Dristle

(10) Patent No.: US 10,016,653 B2
(45) Date of Patent: Jul. 10, 2018

(54) FACE AND LIPS EXERCISE APPARATUS AND METHODS OF USING THE SAME

(71) Applicant: Ronald L. Dristle, Bartlett, IL (US)

(72) Inventor: Ronald L. Dristle, Bartlett, IL (US)

( * ) Notice: Subject to any disclaimer, the term of this patent is extended or adjusted under 35 U.S.C. 154(b) by 0 days.

(21) Appl. No.: 15/250,140

(22) Filed: Aug. 29, 2016

(65) Prior Publication Data

US 2016/0361591 A1 Dec. 15, 2016

Related U.S. Application Data

(63) Continuation of application No. 14/074,006, filed on Nov. 7, 2013, now Pat. No. 9,427,621.

(Continued)

(51) Int. Cl.

*A63B 23/03* (2006.01)
*A63B 21/00* (2006.01)

(Continued)

(52) U.S. Cl.

CPC ..... *A63B 23/032* (2013.01); *A61H 1/00* (2013.01); *A63B 21/0004* (2013.01); *A63B 21/4003* (2015.10); *A63B 21/4025* (2015.10); *A63B 21/4035* (2015.10); *A63B 23/03* (2013.01); *A61H 23/02* (2013.01); *A61H 2201/0207* (2013.01); *A61H 2201/0214* (2013.01); *A61H 2201/0257* (2013.01); *A61H 2201/1604* (2013.01); *A61H 2205/02* (2013.01); *A61H 2205/022* (2013.01); *A63B 23/025* (2013.01);

(Continued)

(58) Field of Classification Search

CPC ..... A63B 23/032; A63B 23/03; A63B 23/025; A63B 21/4035; A63B 21/4025; A63B 21/4003; A61H 2205/22; A61H 2205/02; A61H 2201/1604

See application file for complete search history.

(56) References Cited

U.S. PATENT DOCUMENTS 3,744,485 A * 7/1973 Worthy ..... A63B 23/032 482/11
3,805,771 A * 4/1974 Wright ..... A61C 7/00 482/11

(Continued)

*Primary Examiner* — Loan H Thanh
*Assistant Examiner* — Megan Anderson
(74) *Attorney, Agent, or Firm* — Scherrer Patent & Trademark Law, P.C.; Stephen T. Scherrer; Monique A. Morneault

(57) ABSTRACT

The present invention relates to apparatuses and methods for exercising the facial muscles. Specifically, the present invention relates to a series of apparatuses that may be placed against or behind a user's lips, on a user's face, under a user's chin, and/or against a user's neck. As a user performs exercises with the present invention, the corresponding facial muscles become more strengthened and toned. Toning the muscles in one's face helps to reduce wrinkles, sagging, and expression marks that have developed over time. In addition, exercising of the neck region helps strengthen the soft palate that may be useful for snore prevention or singing. The apparatuses and methods described herein may be utilized for rehabilitation for stroke victims, individuals with speech impediments and other speech pathology, may increase collagen production in the lips, and may be utilized to increase blood flow to the neck, throat and face.

7 Claims, 8 Drawing Sheets

Related U.S. Application Data

(60) Provisional application No. 61/723,536, filed on Nov. 7, 2012.

(51) Int. Cl.
*A61H 1/00* (2006.01)
*A61H 23/02* (2006.01)
*A63B 23/025* (2006.01)

(52) U.S. Cl.
CPC ..... *A63B 2225/64* (2013.01); *A63B 2225/66* (2013.01)

(56) References Cited

U.S. PATENT DOCUMENTS

| | | | | |
|---|---|---|---|---|
| 6,524,225 | B1 * | 2/2003 | Arias | A63B 23/032 482/11 |
| 7,857,831 | B2 * | 12/2010 | Ishikawa | A63B 23/18 128/861 |
| 2003/0073542 | A1 * | 4/2003 | Patton | A63B 23/032 482/10 |
| 2016/0228741 | A1 * | 8/2016 | Noguchi | A61H 23/004 |
| 2017/0050077 | A1 * | 2/2017 | Matsushita | A63B 23/03 |

* cited by examiner

FACE AND LIPS EXERCISE APPARATUS AND METHODS OF USING THE SAME

The present invention is a continuation application of U.S. patent application Ser. No. 14/074,006, titled "Face and Lips Exercise Apparatus and Methods of Using the Same," filed Nov. 7, 2013, which claims priority under 35 U.S.C. 119 to U.S. Provisional Patent Application No. 61/723,536, titled "Face and Lips Exercise Apparatus and Methods of Using the Same", filed Nov. 7, 2012, each of which is incorporated herein by reference in its entirety.

TECHNICAL FIELD

The present invention relates to apparatuses and methods for exercising the facial muscles. Specifically, the present invention relates to a series of apparatuses that may be placed against or behind a user's lips, on a user's face, under a user's chin, or against a user's neck. As a user performs exercises with the present invention, the corresponding facial muscles become more toned. Toning the muscles in one's face helps to reduce wrinkles, sagging, and expression marks that have developed over time. In addition, exercising of the neck region helps strengthen the soft palate that may be useful for snore prevention or singing. The apparatuses and methods described herein may be utilized for rehabilitation for stroke victims, individuals with speech impediments and other speech pathology, may increase collagen production in the lips, and may be utilized to increase blood flow to the neck, throat and face.

BACKGROUND

It is, of course, generally known to exercise muscles in the human body. Exercising helps to enhance or maintain physical fitness, health and wellness, and physical appearance. Exercise may be aerobic and focused on cardiovascular endurance, anaerobic and focused on increasing muscle strength, focused on flexibility and improving the range of motion of muscles and joints, and/or focused on toning, losing fat, and appearing lean.

Frequently, many people focus purely on enhancing or maintaining their physical appearance. This is a result of increasingly high societal standards of beauty. Historically, young, smooth skinned, well-proportioned people have been deemed beautiful. Generally, exercise is required to obtain or maintain young, smooth, and toned features.

Ordinarily, exercising the facial muscles is difficult because there are internal muscles that one cannot easily move or manipulate. It is generally known to exercise facial muscles by using apparatuses or one's hands to add resistance. These apparatuses may be placed inside one's mouth or held in place with one's hands. However, many apparatuses designed to exercise user's facial and/or neck muscles are difficult to use, and produce minimal effects.

Commonly, people take shortcuts or find alternatives to exercise in order to enhance or maintain their physical appearance. Electrotherapy is a passive means of exercising the facial muscles through electro-stimulation. Low electric currents are passed through the skin to force muscle contraction and simulate facial exercise. While generally safe, electrotherapy is not to be used by pregnant women, people with metal implants or pacemakers, or people using certain medications. In addition, the benefits of electro-stimulation are far from known, and the long-term implications of using electro-stimulation as a muscle exerciser is unknown.

Alternatively, cosmetic and plastic surgery can replace exercise to produce lean features and/or increase collagen within lips, for example, to produce full lips and other facial features. However, cosmetic surgery often involves higher risks, higher costs, and recurring surgical consults. Specifically, a rhytidectomy or a "facelift", is becoming a more and more popular alternative to facial exercise. Facelifts involve cosmetic surgery that removes excess facial skin, tightens underlying tissue, and repositions the remaining facial skin unto a patient's face or neck. Facelifts require surgery, recovery time, and thousands of dollars. Moreover, while cosmetic surgery may produce results that are somewhat similar to facial and neck exercises, in reality the muscle are not strengthened and, indeed, may become weaker due to the recovery necessary from the surgeries.

Individuals with medical problems may lose certain control of muscles in their neck and face. For example, stroke victims may lose muscles control over parts of their neck and face, making it difficult to manipulate their muscles naturally. In addition, individuals with brain injuries or other brain issues may have speech impediments or other speech issues, making it difficult for a person to speak.

Therefore, a need exists for apparatuses and methods for aiding in facial, neck and/or lip toning.

Moreover, a need exists for hands free facial, neck and/or lip toning and/or strengthening apparatuses.

Furthermore, a need exists for cost-effective safe apparatuses and methods to replace expensive and risky surgeries and/or electro-stimulation.

Additionally, a need exists for apparatuses and methods that may be simple to use and efficiently provide strengthening and toning of muscles in the face and neck areas of a use.

A need exists for apparatus and methods that may be utilized routinely and regimented to produce increased muscle tone and control, and increased collagen production to specific facial areas.

In addition, a need exists for apparatuses and methods that increase blood flow to neck, throat and neck regions, and may increase skin collagen production for full lips and/or other facial features.

SUMMARY OF THE INVENTION

The present invention relates to apparatuses and methods for exercising the facial muscles. Specifically, the present invention relates to a series of apparatuses that may be placed against or behind a user's lips, on a user's face, under a user's chin, or against a user's neck. As a user performs exercises with the present invention, the corresponding facial muscles become more toned. Toning the muscles in one's face helps to reduce wrinkles, sagging, and expression marks that have developed over time. In addition, exercising of the neck region helps strengthen the soft palate that may be useful for snore prevention or singing. The apparatuses and methods described herein may be utilized for rehabilitation for stroke victims, individuals with speech impediments and other speech pathology, may increase collagen production in the lips, and may be utilized to increase blood flow to the neck, throat and face.

To this end, in an embodiment of the present invention, a face and lip apparatus is provided, the face and lip apparatus comprising an extended flat article having a first end and a second end; the first end comprising a narrow portion, wherein the narrow portion extends outwardly from the user's face; the second end comprising a widened portion, wherein the widened portion comprises at least one extending arcuately shaped ridge for holding the face and lip apparatus with a user's lips.

In another embodiment, an apparatus for exercising the face and lips of a user is provided. The apparatus comprises an extended article having a main body, a first end and a second end, the first end having a lip engaging element, wherein the lip engaging element comprises a first ridge disposed laterally across the first end of the extended article extending upwardly from the first end of the extended article, and a second ridge disposed laterally across the first end of the extended article and extending downwardly from the first end of the extended article, the first and second ridges being placed behind the upper and lower lips, respectively, of a user for exercising the user's lips and face.

In an embodiment, the first end of the extended article is wider than the main body.

In an embodiment, the main body is cylindrical, and the first end is flattened and widened relative to the main body.

In an embodiment, the apparatus further comprises a pointing device on the second end of the extended article, wherein the pointing device is used to point in various directions by a user when the first and second ridges are placed behind the upper and lower lips.

In an embodiment, the pointing device is a light for shining on objects when the apparatus is used to exercise the lips and face of the user.

In an embodiment, the apparatus further comprises a handle extending from the main body, wherein the handle aids in stabilizing the apparatus when used by a user to exercise the lips and face thereof.

In an embodiment, the apparatus further comprises a linkage on the main body; and a handle extending from the linkage for holding the apparatus by a user, wherein the handle is loosely attached to the linkage.

In an embodiment, a method of exercising the lips and face using the apparatus is provided. The method comprises placing the first ridge behind the upper lips of a user, and placing the second ridge behind the lower lips of a user; and manipulating the upper and lower lips to move the apparatus in different directions.

In an embodiment, the method further comprises the steps of providing a pointing device on the second end of the elongated article; and moving the apparatus using the upper and lower lips to point the apparatus in different directions using the pointing device.

In an embodiment, the pointing device is light, and further the method comprises the steps of providing an objects; and moving the apparatus using the upper and lower lips to point the light at the object.

In an alternate embodiment of the present invention, an apparatus for exercising the lips of a user comprising a main body portion, a first end and a second end, the first end comprising lip engaging elements, the second end comprising a handle for holding the same, wherein the lip engaging elements comprise a first concave surface on an upper portion of the first end and a second concave surface on a lower portion of the first end, the first concave surface for engaging the upper lip of a user and the second concave surface for engaging the lower lip of a user.

In an embodiment, the first end is wider than the main body portion and the handle.

In an embodiment, the apparatus further comprises a ridge between the first concave portion and the second concave portion, isolating the first concave portion from the second concave portion.

In an embodiment, the apparatus further comprises a textured surface within the first and second concave portions for engaging with the lips of the user.

In an embodiment, the first and second concave portions are disposed laterally across the first end of the apparatus.

In an embodiment, a system for exercising the lips of a user is provided. The system comprising the apparatus further comprising an adhesive strip for placing on at least one of the lips of the user for holding the at least one lip in a peeled back configuration.

In an embodiment, a method of exercising the lips of a user using the apparatus comprises the steps of curling the upper and lower lips back to reveal inside portions of the upper and lower lips; placing the first concave surface over the exposed inside portion of the upper lip; and placing the second concave surface over the exposed inside portion of the lower lip.

In an alternate embodiment of the present invention, an apparatus for exercising the lips of a user is provided. The apparatus comprises a main body portion, a first end and a second end, wherein the first end comprises an upper flat, elongated surface on a top of the first end and a lower flat, elongated surface on a bottom of the first end, and the second end comprising handle for holding the same.

In an embodiment, the upper and lower surfaces are spaced apart from each other.

In an embodiment, a method of exercising lips of a user using the apparatus is provided. The method comprises the steps of: placing the first end of the apparatus in the user's mouth so that the upper lip of the user contacts the upper surface of the apparatus and the lower lip of the user contacts the lower surface of the apparatus; and manipulating the upper and lower lips to move the apparatus.

It is, therefore, an advantage and objective of the present invention to provide apparatuses and methods for aiding in facial, neck, and/or lip strengthening and/or toning.

Moreover, it is an advantage and objective of the present invention to provide apparatuses and methods for hands-free facial, neck and/or lip strengthening and/or toning.

Furthermore, it is an advantage and objective of the present invention to provide for cost-effective and safe apparatuses and methods to replace expensive and risky surgeries and/or electro-stimulation.

Additionally, it is an advantage and objective of the present invention to provide apparatuses and methods that are simple to use and effectively strengthen and/or tone facial and/or neck muscles.

It is an advantage and objective of the present invention to provide apparatus and methods that may be utilized routinely and regimented to produce increased muscle tone and control, and increased collagen production to specific facial areas.

In addition, it is an advantage and objective of the present invention for apparatuses and methods that increase blood flow to neck, throat and face regions and to the brain, and may increase skin collagen production for full lips and/or other facial features.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to apparatuses and methods for exercising the facial muscles. Specifically, the present invention relates to a series of apparatuses that may be placed against or behind a user's lips, on a user's face, under a user's chin, or against a user's neck. As a user performs exercises with the present invention, the corresponding facial, lip and/or neck muscles become strengthened and more toned. Toning the muscles in one's face helps to reduce wrinkles, sagging, and expression marks that have developed over time. In addition, exercising of the neck region helps strengthen the soft palate that may be useful for snore prevention or singing. The apparatuses and methods described herein may be utilized for rehabilitation for stroke victims, individuals with speech impediments and other speech pathology, may increase collagen production in the lips, and may be utilized to increase blood flow to the neck, throat and face.

Figure 1:
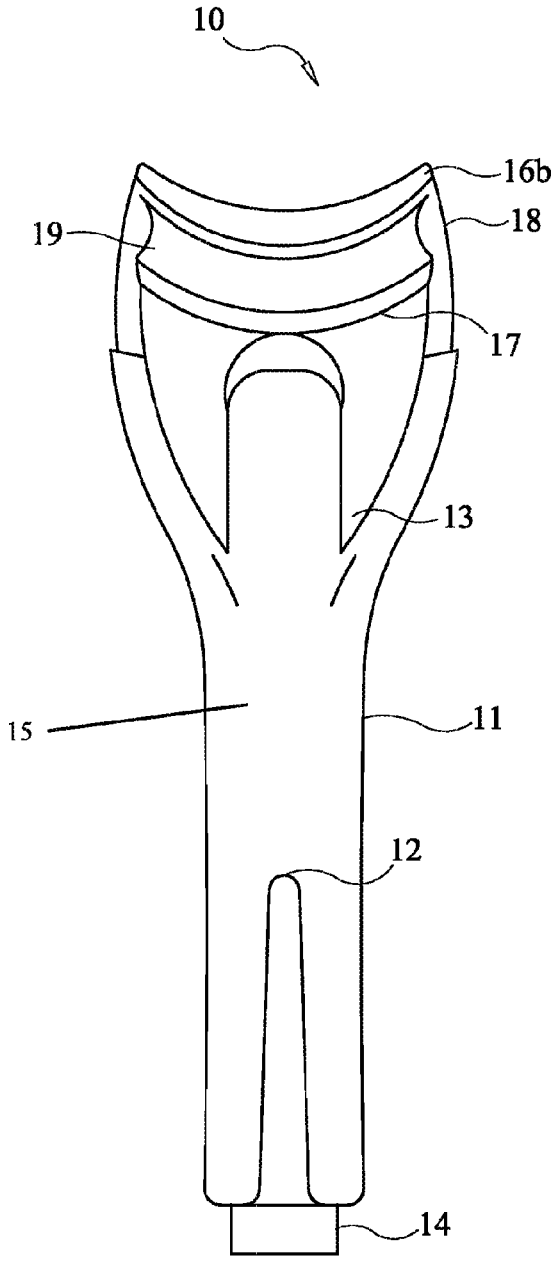
FIG. 1 illustrates a top view of a face and lip toning apparatus in an embodiment of the present invention.
Figure 2:
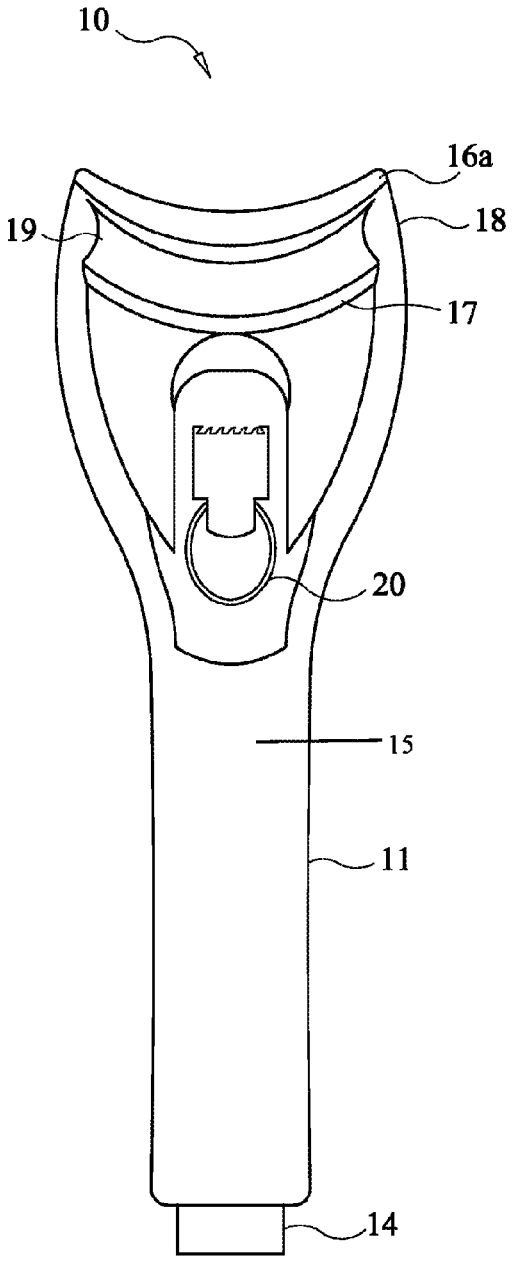
FIG. 2 illustrates a bottom view of the face and lip toning apparatus in an embodiment of the present invention.
Figure 3:
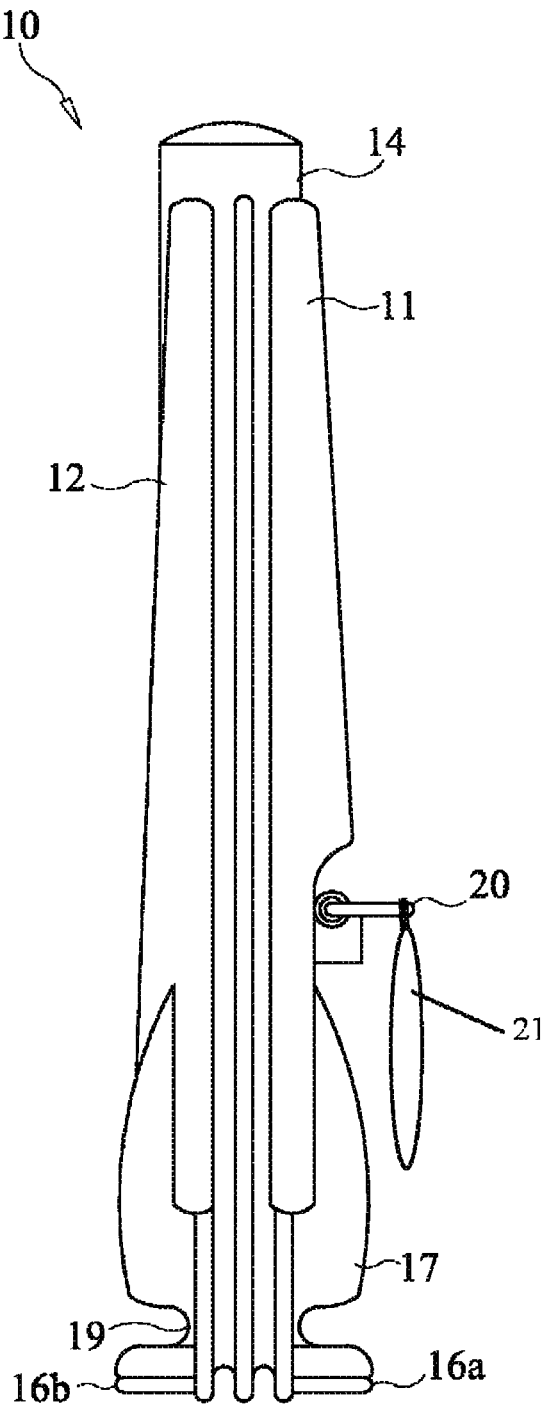
FIG. 3 illustrates a side view of the face and lip toning apparatus in an embodiment of the present invention.

Now referring to the figures, wherein like numerals refer to like parts, FIGS. 1-3 illustrate a face and lip toning apparatus 10. The face and lip toning apparatus 10 may be comprised of a main body 15 comprising a casing 11. The casing 11 may have an opening 12 on a first end and slot 13 on a second end. The opening 12 may extend outwardly away from the second end. The opening 12 may be large enough to hold a pointing device 14. The pointing device 14 may be a small flashlight, a light emitting diode, a laser pointer, an elongated stick, or any other pointing device known to one skilled in the art.

The face and lip toning apparatus 10 may have a widened base 18 that may be inserted into the slot 13. After inserting the wide base 18 into the casing 11 through the slot 13, the face and lip toning apparatus 10 may be inserted into a user's mouth. The face and lip apparatus 10 may have a bottom arcuately shaped inner ridge 16*a* and a top arcuately shaped inner ridge 16*b* on the second end. The bottom arcuately shaped inner ridge 16*a* and the top arcuately shaped inner ridge 16*b* may be placed between a user's teeth and lips. The bottom arcuately shaped inner ridge 16*a*, as shown in FIGS. 2, 3, may be placed behind a user's lower lip. The top arcuately shaped inner ridge 16*b*, as shown in FIGS. 1, 3, may be placed behind a user's upper lip. The user may close his or her mouth and, specifically, lips around the bottom arcuately shaped inner ridge 16*a* and the top arcuately shaped inner ridge 16*b*, securing the face and lip toning apparatus 10 in place. The face and lip toning apparatus 10 may further comprise a plurality of arcuately shaped outer ridges 17.

A user may place his or her lips between the plurality of arcuately shaped outer ridges 17 and the bottom arcuately shaped inner ridge 16*a* and the top arcuately shaped inner ridge 16*b* into a plurality of arcuately shaped lip recesses 19. The user may hold the face and lip apparatus 10 in place by his or her lips and facial muscles. The user may further contract different facial muscles in order to direct pointing device 14 at specific locations. A mat or poster (not shown) may be utilized to allow a user to point to specific indicia in order to train and tone specific facial muscles. For example, an exercise regime may require that a user point the pointing device 14 at specific locations on a mat or at objects in a particular order, thereby exercising and toning the facial and lip muscles, thereby toning the same. As noted, the pointing device 14 may preferably be light emitting device, and the light may be trained on the mat or any other location by the user's face and lip muscles to exercise the same. The user may also make shapes, letters, numbers, words, or other figures that would exercise the facial muscles.

As shown in FIGS. 2, 3, an attaching link 20 may be disposed on the bottom of the face and lip apparatus 10. The attaching link 20 may allow for a handle 21 to be optionally attached to the face and lip apparatus 10. The attaching link 20 may be a ring, a hook, a cap, a button, or may fasten the handle 21 by any other method known to one skilled in the art. The handle 21 may provide additional support and aid a user in moving the face and lip apparatus 10 during an exercise routine.

Figure 4:
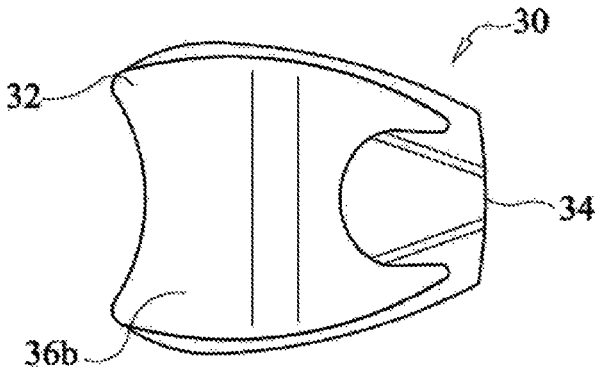
FIG. 4 illustrates a top view of a face and lip toning apparatus in an alternate embodiment of the present invention.
Figure 5:
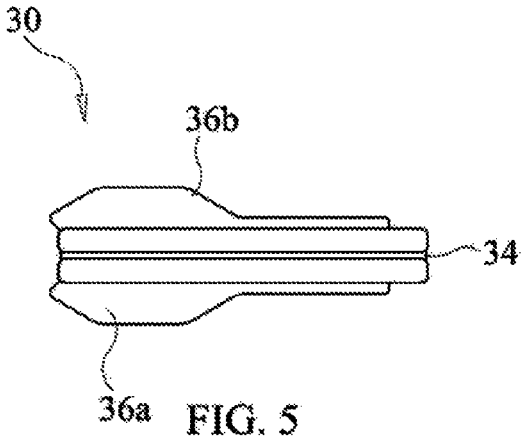
FIG. 5 illustrates a side view of the face and lip toning apparatus in an alternate embodiment of the present invention.

As shown in FIGS. 4 and 5, a face and lip toning apparatus 30 is described. The face and lip toning apparatus 30 may comprise an arcuate end 32 and a flat handling end 34. The arcuate end 32 may comprise a bottom wide thick ridge 36*a* and a top wide thick ridge 36*b* that may be held in place by a user's lips. The user may insert the face and lip toning apparatus 30 into his or her mouth and rest the bottom wide thick ridge 36*a* on his or her bottom lip. The user may then close his or her mouth and rest his or her top lip on the top wide thick ridge 36*b*. The user may then apply pressure to the face and lip toning apparatus 30 and hold the same in place by the user's lips. The face and lip toning apparatus 30 may be inserted and removed from the user's mouth by using the flat handling end 34.

The user may exercise facial muscles by holding the face and lip toning apparatus 30 in place or the user may exercise specific facial muscles by moving the face and lip toning apparatus 30 in different directions. The face and lip toning apparatus 30 may be used independently or may be inserted into the previously described casing 11 through the slot 13 shown in FIGS. 1, 3 to utilize the pointing device for further exercises.

As shown in FIGS. 6A-9, a lip pucker toning apparatus 50 is shown and described. The lip pucker toning apparatus 50 may have a plurality of arcuately-shaped or concave-shaped recesses 52*a*, 52*b* on a first end. The plurality of recesses 52*a*, 52*b* may be shaped to conform to a user's lips. Preferably, the lip pucker toning apparatus 50 has a pair of arcuately-shaped recesses 52*a*, 52*b*, a first for a user's upper lip and a second for a user's lower lip. Specifically, first arcuately-shaped recess 52*a* may have a first concave surface and may include an upper ridge 53*a*, a medial trough 55*a* and a lower ridge 57*a*, and the second arcuately-shaped recess 52*b* may have a second concave surface and may include an upper ridge 53*b*, a medial trough 55*b* and a lower ridge 57*b*. The upper ridges 53*a*, 53*b*, the medial troughs 55*a*, 55*b* and the lower ridges 57*a*, 57*b* may be disposed laterally across the first end of the lip pucker toning apparatus 50 from a first side to a second side thereof.

The plurality of recesses 52 may have a corrugated, roughened or textured surface 54 such that the lip pucker toning apparatus 50 may be gripped by a user's lips without slippage of the same. The lip pucker toning apparatus 50 may be generally held in place by placing two-sided adhesive directly on the upper and lower lips, or in the vicinity thereof, of a user prior to using the lip pucker apparatus 50 for exercising the user's lips.

For example, a user may utilize a rod, placed above his or her upper lip or below his or her lower lip. If the rod is placed above the user's upper lip, the user may curl his or her upper lip upwardly toward his or her nose and around the rod to position the upper lip appropriately to be placed against one of the recesses of the lip pucker apparatus 50. Additionally, if the rod is placed below the user's lower lip, the user may curl his or her lower lip downwardly toward his or her chin and around the rod to position the lower lip appropriately to be placed against one of the recesses of the lip pucker apparatus 50. Thus, the user's upper lip and/or lower lip may be curled into a position useful for utilizing the lip pucker apparatus 50 for exercises thereof. The rod may be removed from behind the upper and/or lower lip prior to using the lips for exercising the same.

Figure 6A:
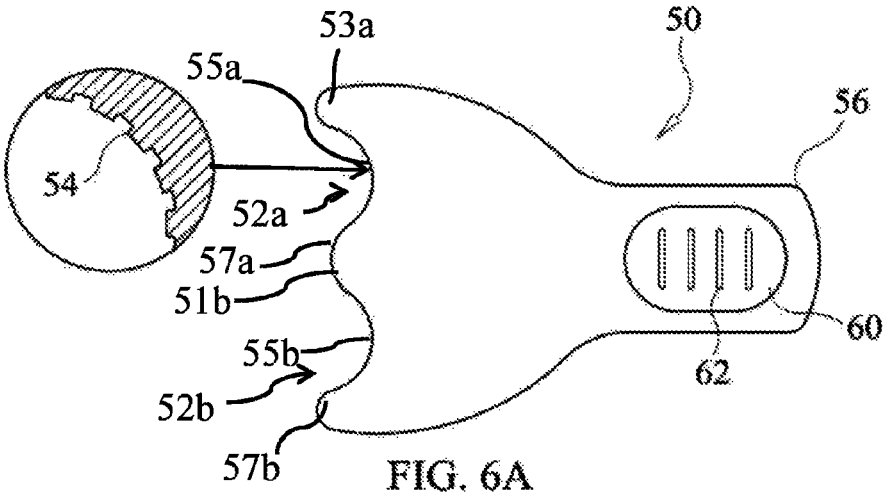
FIG. 6A illustrates a side view of a lip pucker toning apparatus in an alternate embodiment of the present invention.
Figure 6B:
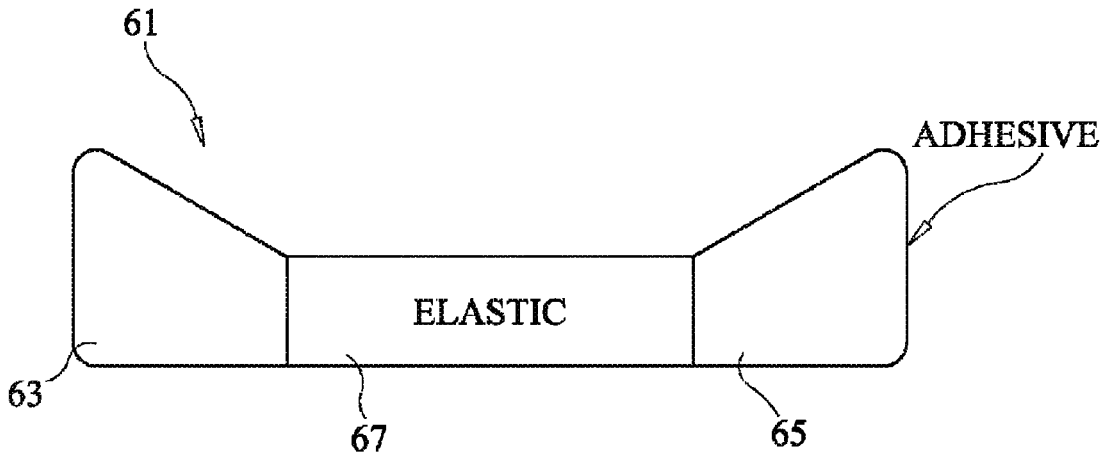
FIGS. 6B-6C illustrate an adhesive strip useful to hold a user's lips in proper exercise position in an embodiment of the present invention.
Figure 6C:
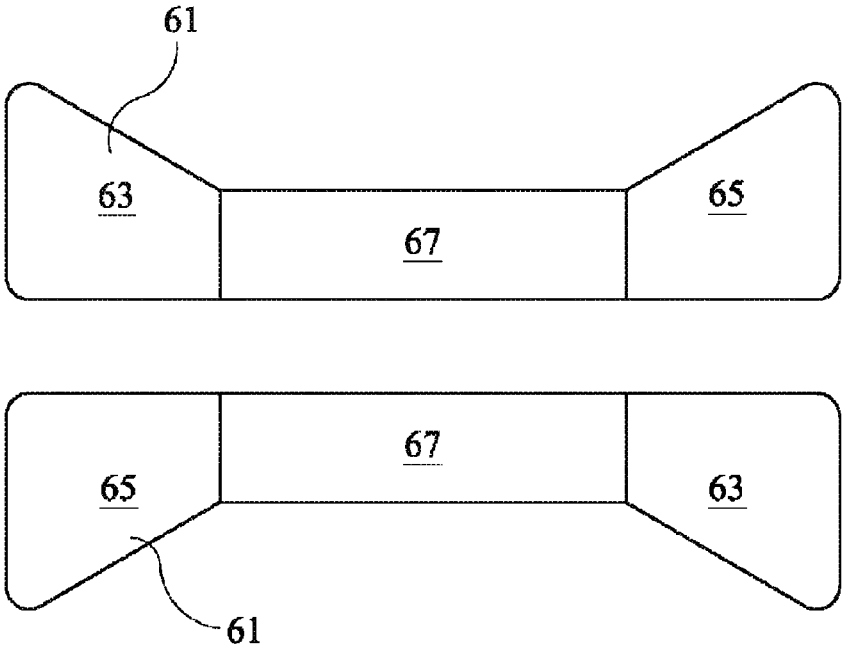

To aid the user in positioning his or her lips and holding the lips in the proper position for exercising the same, an adhesive tape, such as a double-sided adhesive, for example, may be placed above the user's upper lip and/or below the user's lower lip to hold the user's upper and/or lower lip in the proper position for engaging with the lip pucker exercise apparatus 50. Alternatively, an adhesive strip may be disposed across the user's lips to hold the same in the proper position. For example, as illustrated in FIG. 6B, an adhesive strip 61 may be sized to be disposed over the user's upper lip as it is in a curled back position to hold the lip while exercising the same. The adhesive strip may be shaped to hold the lip in a curled back position, but to clear the user's nose or chin. In addition, a pair of adhesive strips 61 may be disposed on the user's lips, one for the upper lip and one of the lower lip adjacently to hold both the upper and lower lips in the proper position, as illustrated in FIG. 6C.

The adhesive strip 61 may have a two side adhesive portions 63, 65 and a center elastic portion 67. The side adhesive portions 63, 65 may have a removable adhesive thereon, that allows a user to hold his or her upper or lower lip in the proper exercise position, but may be easily peeled from the user's face when desired. The elastic portion 67 may stretch across the user's lip, providing sufficient and significant resistance on the user's lip to hold the lip in the proper position.

Figure 7:
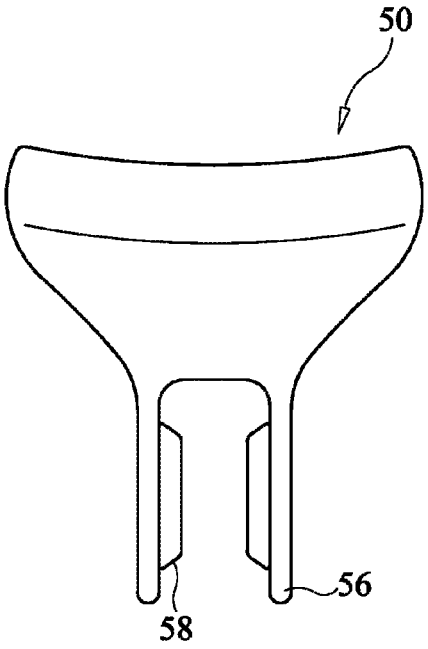
FIG. 7 illustrates a top view of the lip pucker toning apparatus in an alternate embodiment of the present invention.
Figure 8:
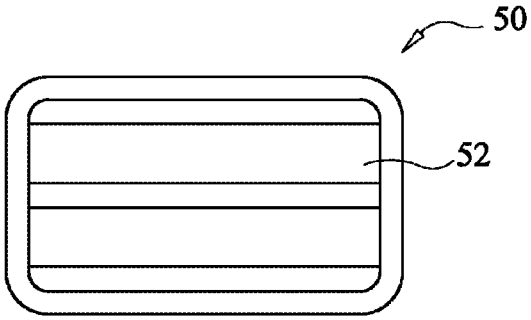
FIG. 8 illustrates a front view of the lip pucker toning apparatus in an alternate embodiment of the present invention.
Figure 9:
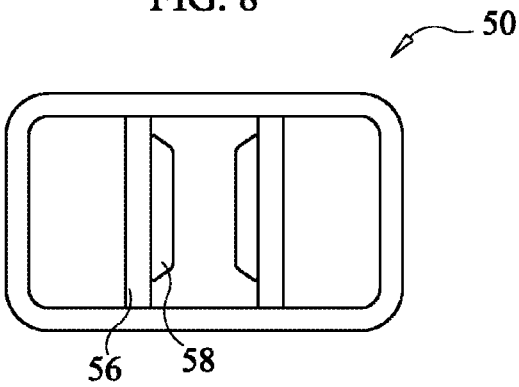
FIG. 9 illustrates a back view of the lip pucker toning apparatus in an alternate embodiment of the present invention.

The lip pucker toning apparatus 50 may have a plurality of extensions 56 on a second end. The plurality of extensions 56 may extend outwardly away from the plurality of recesses 52. The plurality of extensions 56 may comprise a plurality of grooves 58, as seen in FIG. 7. The plurality of grooves 58 may be circular, arcuate, or fingerprint shaped such that a user may hold, apply, or remove the lip pucker toning apparatus 50. The plurality of grooves 58 may also have a gripping surface 60, as seen in FIG. 6. The gripping surface 60 may be made of rubber, leather, synthetic composite, or alternate tacky surface known to one skilled in the art. The gripping surface 60 may additional have a plurality of ribs 62 for grip.

A user may place his or her lips into the plurality of recesses 52 to hold the lip pucker toning apparatus 50 in place. The user may grip the lip pucker toning apparatus 50 via the extensions 56 and apply pressure against the lips, whereupon the user may utilize the resistance provided to exercise the lip pucker muscles by manipulating his or her lips against the recesses 52. The lip pucker apparatus 50 may further have an optional vibrator device that may vibrate the apparatus to stimulate the user's lips when in use, increasing blood flow and collagen formation.

Figure 10:
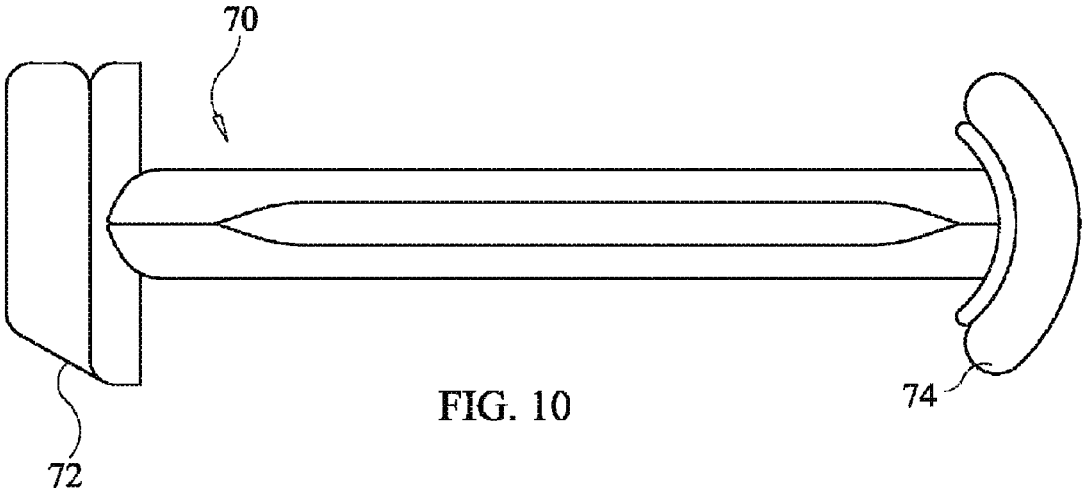
FIG. 10 illustrates a side view of a throat resistance apparatus in an alternate embodiment of the present invention.
Figure 11:
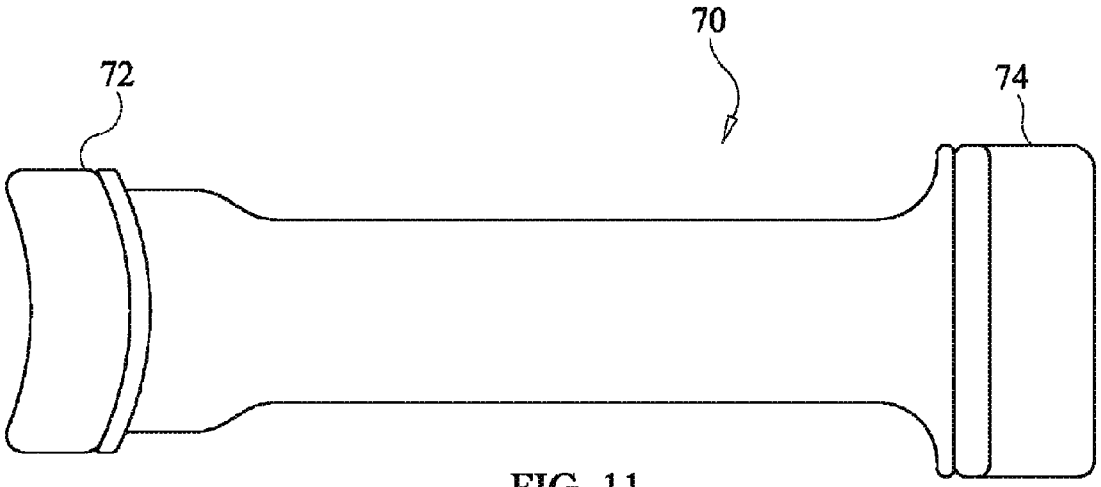
FIG. 11 illustrates a top view of a throat resistance apparatus in an alternate embodiment of the present invention.
Figure 12:
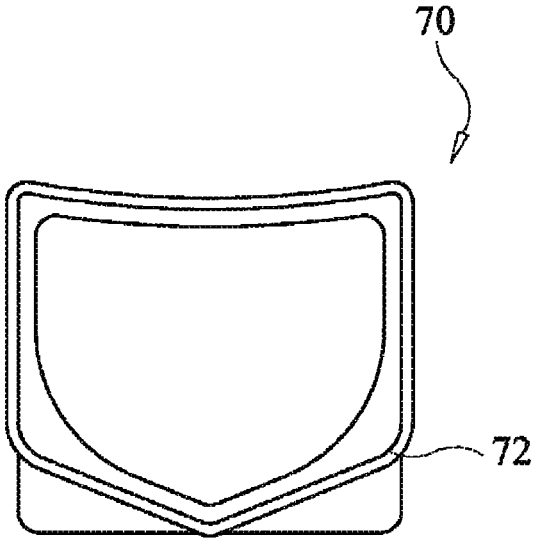
FIG. 12 illustrates a back view of a throat resistance apparatus in an alternate embodiment of the present invention.

As shown in FIGS. 10-12, a throat resistance apparatus 70 is described. The throat resistance apparatus 70 may comprise a first padded end 72 on a first end. The first padded end 72 may be concavely formed, as shown in FIG. 11, to fit at the base of the neck and throat between the right and left collarbones. As shown in FIG. 12, the first padded end 72 may be pentagonal or similarly shaped, when viewed directly, to fit the recess at the base of the neck. The throat resistance apparatus 70 may further comprise a second padded end 74 on a second end. The second padded end 74 may be convexly formed to fit the shape of the upper neck and throat area. As shown in FIG. 11, the second padded end 74 may be rectangular when viewed from above.

A user may position the throat resistance apparatus 70 at the base of his or her neck and rest his or her upper neck on the second padded under 74. From here, the user may apply pressure against the neck while flexing the neck and/or throat muscles. A user may additionally move his or her tongue to target the soft and hard palates. The first padded end 72 and second padded end 74 may be interchangeable with alternate attachments (not shown) to accommodate different exercises and functions.

Figure 13:
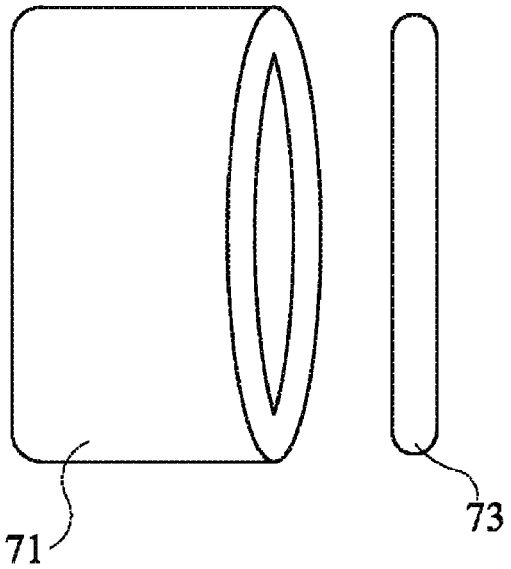
FIG. 13 illustrates an elastic cap that may be fitted on an end of the throat resistance apparatus in an embodiment of the present invention.

As illustrated in FIG. 13, an elastic cap 71 may be provided that may fit over the first padded end 72 or the second padded end 74, and may hold a heating pad or a cold pad 73 therein and on the first padded end 72 or second padded end 74. Thus, when in use, the user may apply heat and/or cold to the exercise area when in use. The elastic cap 71 may be similar to a shower cap, in that it may be elastic so that a user may stretch the same over the ends 72, 74, and hold a heated pad or a cold pad 73.

Figure 14:
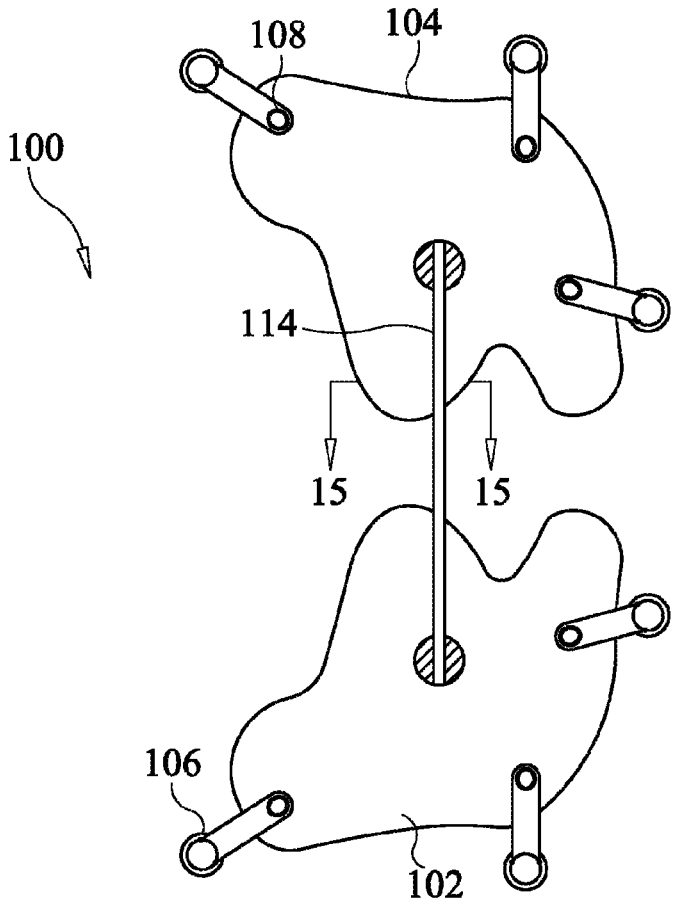
FIG. 14 illustrates a front view of a facial toning apparatus in an alternate embodiment of the present invention.
Figure 15:
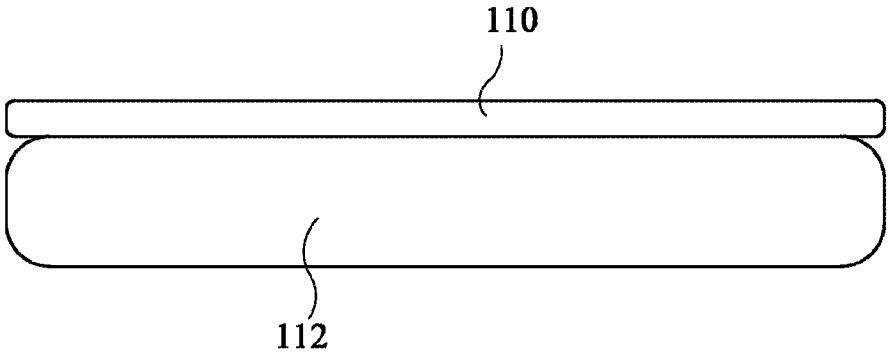
FIG. 15 illustrates a cross-sectional view of a facial toning apparatus in an alternate embodiment of the present invention.

As shown in FIGS. 14-15, a facial toning apparatus 100 is described. The facial toning apparatus 100 may be comprised of a left partial facial compression pad 102 and a right partial facial compression pad 104. The left partial facial compression pad 102 and the right partial facial compression pad 104 may be made of a hard outer surface 110 and an inside padding 112, as shown in FIG. 14. The hard outer surface 110 may be made from molded plastic, metal, fiberglass, or any other hard malleable surface known to one skilled in the art. The inside padding 112 may be thicker than the hard outer surface 110 and made of sponge, foam, plastic polymer, or other soft comfortable material known to one skilled in the art. The left partial facial compression pad 102 and right partial facial compression pad 104 may be placed on the left side of the face and the right side of the face, respectively.

The left partial facial compression pad 102 and the right partial facial compression pad 104 may be formed in such a way as to leave the eye, nose, lips, and chin exposed when the facial toning apparatus 100 is applied to the face. The left partial facial compression pad 102 may be connected to the right partial facial compression pad 104 by attaching adjustable straps (not shown) around a user's head. The adjustable straps (not shown) may be attached to the facial toning apparatus 100 through a plurality of rings 106 or other fastening means disposed on the left partial facial compression pad 102 and the right partial facial compression pad 104. The plurality of rings 106 may be directly secured to the left partial facial compression pad 102 and the right partial facial compression pad 104, but may be rotatable around a pivotal attachment 108.

A compression bar 114 may be disposed on the front of the facial toning apparatus 100 and attached to the middle of the left partial facial compression pad 102 and the right partial facial compression pad 104. Tightening the compression bar 114 and adjustable straps (not shown) may allow for a comfortable support of the facial muscles while performing lip or facial exercises. The facial toning apparatus 100 may be used concurrently with the previously mentioned embodiments shown in FIGS. 1-12.

Additionally, all embodiments may have a battery operated vibration function (not shown). The battery operated vibration function (not shown) may be used before and after exercise in order to get extra blood to flow through the facial muscles during exercise performance using the embodiments described herein.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. An apparatus for exercising the face and lips of a user comprising:

a main body having a first end and a second end; the first end having a lip engaging element, wherein the lip engaging element comprises a first ridge disposed laterally across the first end of the main body extending upwardly from the first end of the main body, and a second ridge disposed laterally across the first end of the main body and extending downwardly from the first end of the main body, the first and second ridges being placed behind upper and lower lips, respectively, of the user for exercising the user's lips and face; and a pointing device on the second end of the main body, wherein the pointing device is used to point in various directions by the user when the first and second ridges are placed behind the upper and lower lips of the user, wherein the pointing device is a light for shining on objects when the apparatus is used to exercise the lips and face of the user.

2. A method of exercising the lips and face using the apparatus of claim 1, comprising the steps of:

placing the first ridge behind the upper lips of the user, and placing the second ridge behind the lower lips of the user; and manipulating the upper and lower lips of the user to engage the apparatus in different directions.

3. The method of claim 2 further comprising the step of:

providing an object; and moving the apparatus using the upper and lower lips of the user to point the light at the object.

4. The apparatus of claim 1 wherein the first end of the main body is arcuately shaped to fit the user's mouth.

5. The apparatus of claim 1 wherein the main body is cylindrical, and the first end is flattened and widened relative to the main body.

6. The apparatus of claim 1 further comprising:

a handle extending from the main body, wherein the handle aids in stabilizing the apparatus when used by the user to exercise the lips and face thereof.

7. The apparatus of claim 1 further comprising:

a linkage on the main body; and a handle extending from the linkage for holding the apparatus by the user.

* * * * *